US005457442A

United States Patent [19]

Lucero

[11] Patent Number: 5,457,442

[45] Date of Patent: Oct. 10, 1995

[54] REMOTE CONTROLLED INTRUDER DETETION AND WARNING SYSTEM

[76] Inventor: William H. Lucero, 2902 Drexel Dr., Huntsville, Ala. 35801

[21] Appl. No.: 54,143

[22] Filed: Apr. 30, 1993

[51] Int. Cl.[6] ..... G08B 23/00; G08B 1/08; G08B 21/00

[52] U.S. Cl. ..... 340/693; 340/539; 340/541

[58] Field of Search ..... 340/539, 593, 340/541, 565, 567

[56] References Cited

U.S. PATENT DOCUMENTS

| | | | |
|---|---|---|---|
| 4,963,854 | 10/1990 | Stuecker | 340/693 X |
| 4,970,494 | 11/1990 | Keely et al. | 340/539 X |
| 4,978,942 | 12/1990 | Bruce | 340/693 X |
| 4,980,672 | 12/1990 | Murphy | 340/693 X |
| 5,146,209 | 9/1992 | Beghelli | 340/693 |
| 5,166,664 | 11/1992 | Fish | 340/539 |

*Primary Examiner*—James J. Groody
*Assistant Examiner*—John W. Miller
*Attorney, Agent, or Firm*—John C. Garvin, Jr.; James E. Staudt

[57] ABSTRACT

The present invention is a wireless alarm system having a transmitter which operates in conjunction with existing intruder detection devices to provide an electromagnetic signal in response to detection of an intruder. The transmitter is attached to, and is pulsed by the detection device. In response to the pulse, a signal is emitted by the transmitter, and is sent to a receiver unit which is electrically connected to a power source remote from the transmitter. The receiver is provided with an electrical switching mechanism and an alarm selection device. When a signal from the transmitter is received by the receiver, the power from the power source is switched by the receiver so as to actuate one or more of selected alarms or electrical components which may be an integral part of or be attached directly to the receiver, or may be located remotely therefrom.

1 Claim, 1 Drawing Sheet

REMOTE CONTROLLED INTRUDER DETETION AND WARNING SYSTEM

BACKGROUND OF INVENTION

1. Field of the Invention

The present invention relates generally to an alarm system for detection of intruders and for warning persons in a home or business of the intruders presence, and more particularly to a system which provides one or more warning signal devices which may be placed in any remote location having electrical power for actuation by a wireless transmitter which responds as a result of detection of an intruder. The invention may be supplied to the consumer in a kit which is readily useable by attachment to a conventional intruder detection device designed to actuate a light which is integral with the detection device.

2. Description of Related Art

Intrusion detection systems for detecting and signaling an alarm when activated by an intruder are well known. The use of transmitters for providing wireless communication between elements of such systems is also known in the art. Exemplary detectors and alarm apparatuses are disclosed in the following U.S. Pat. Nos.: 4,527,151, 4,768,020, 4,963,854, and 5,128,654. Examples of detector systems which utilize wireless transmitters are disclosed in the following U.S. Pat. Nos.: 4,166,273, 4,754,261, 4,772,876, and 5,160,915.

A review of the above listed patents highlights the fact that existing security systems which are capable of remote operation of an alarm, are quite bulky, are very complex, and accordingly very expensive. In addition to the high initial expense, installing and maintaining such complex systems are also costly. Typically, both installation and maintenance of such systems must be done by highly trained technicians. Further, it is axiomatic that the dependability of any system decreases as its complexity increase. The above cited patents do not provide a unique wireless alarm system of the type herein disclosed which may be installed in a matter of minutes by anyone, which provides a warning alarm at any selected location within a home or business, and provides a variety of selected alarm signals at a minimum initial and maintenance cost.

SUMMARY OF INVENTION

The present invention is a wireless alarm system having a transmitter which operates in conjunction with existing intruder detection devices, such as the well known motion detectors, to provide an electromagnetic signal in response to detection of an intruder. The transmitter may, for example, be simply attached externally to a detection device or it may be incorporated into the body of the detector. The transmitter is pulsed by the detection device. In response to the pulse, a signal is emitted by the transmitter, and is sent to a receiver unit which is electrically connected to a power source remote from the transmitter. The receiver is provided with an electrical switching mechanism for actuation of an alarm device. When a signal is received by the receiver the power from the power source is switched by the receiver so as to actuate one or more of selected alarms which may be attached to the receiver or located remotely therefrom.

From the above, and as will be pointed out with more specificity as this specification continues, the present invention provides a unique wireless alarm system which is a practical and inexpensive solution to the high cost and complexity of previous systems having comparable capabilities. The components of the present system are compact and light weight, utilize existing electrical and electronics technologies, and are well adapted for use with existing detection apparatuses such as motion detectors. It is pointed out that detector devices of this type have become increasingly popular because of their low cost and dependability. However, within the context of today's conventional motion detector floodlight systems, the single event of outside lights "coming on" late at night because of an intruder's presence, do not offer an adequate alarm to occupants asleep in a home or building.

In addition to the above mentioned advantages over the prior art, the simplicity of installation and operation of this wireless system is such that it may be installed by anyone who can install a light bulb and insert a plug into an electrical outlet. In use of the system in its simplest forms there are no holes to drill, no special wiring, nor complicated adjustments, and no required interaction with any central control system. Thus, it is clear that the present invention provides a system having capabilities heretofore unattainable by the average home or business owner. Because of its simplicity, and its adaptability for use with existing intruder detection devices, the system may be purchased at department and discount store prices.

Thus the primary objects of the present invention are to provide the above mentioned and later noted advantages over the prior art.

It is a further object of this invention to overcome the disadvantages of the prior art described above while providing an effective system for utilization of state-of-the-art components.

The above and other objects and advantages of this invention will become apparent from the following description considered with the accompanying drawings wherein like reference characters refer to the same parts in the several views.

DESCRIPTION OF PREFERRED EMBODIMENT

Figure 1:
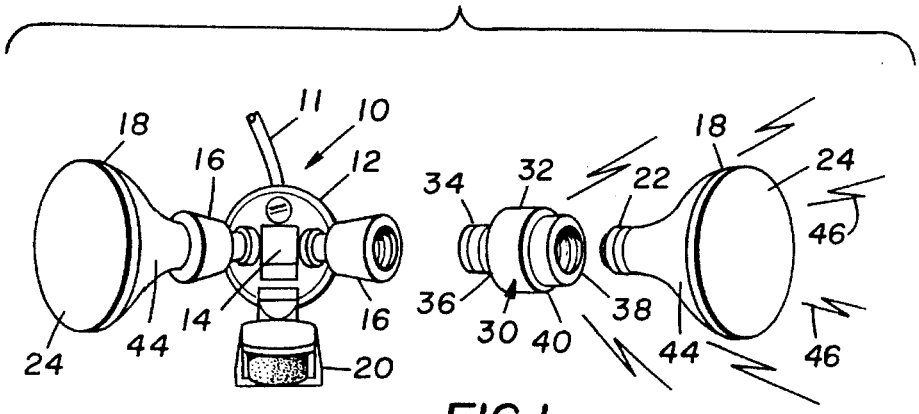
FIG. 1 is a perspective view of a motion detector assembly and a transmitter illustrated in an exploded form, wherein the transmitter is shown in the form of an insert between a floodlight bulb and a socket of the motion detector assembly.

Referring now to FIG. 1 of the drawings, the invention is illustrated in conjunction with a motion detection assembly which includes an electrical fixture which is controlled by a motion detector device. In operation, the motion detector device serves as a primary actuator for the invention as well as for the light fixture. An electrical fixture is illustrated generally by the numeral 10. It is to be understood that the invention may also be used in conjunction with intruder detection devices of other types as well. More specifically, the electrical fixture 10 includes a base 12, a housing 14, a pair of internally threaded light sockets 16 attached to the base 12, a pair of threaded floodlight bulbs 18 adapted for threaded mechanical and electrical connection to the sockets 16, a motion detector 20 which is adapted to actuate an internal switch (not shown) in response to its sensing movement of an object within its viewing area. The detector switch is biased to an "off" position under conditions of inactivity, and is turned "on" in response to operation of the motion detector when movement of an object is detected. Typically the fixture 10 is connected by the base 12 to a building and receives its electrical power from the building electrical power supply 11, which hereinafter will be referred to as a primary power source. A transmitter 30 having a body 32 is adapted for connection to either of the sockets 16 by a threaded male connector 34 which is attached to the body 32 at a first end 36 thereof. It is noted that the body 32 is formed, at least in part, of a material adapted to pass electromagnetic energy therethrough. A threaded female connector 38 is attached to the distal end 40 of the body 32. The female connector 38 is adapted to receive a male threaded portion 22 of the floodlight 18. It is noted that the floodlight bulbs 18 include a reflector portion 44 and a lens portion 24. As noted by the symbolic indication of electromagnetic energy 46, the transmitter 30 is adapted to emit such energy when connected to a power source.

Figure 2:
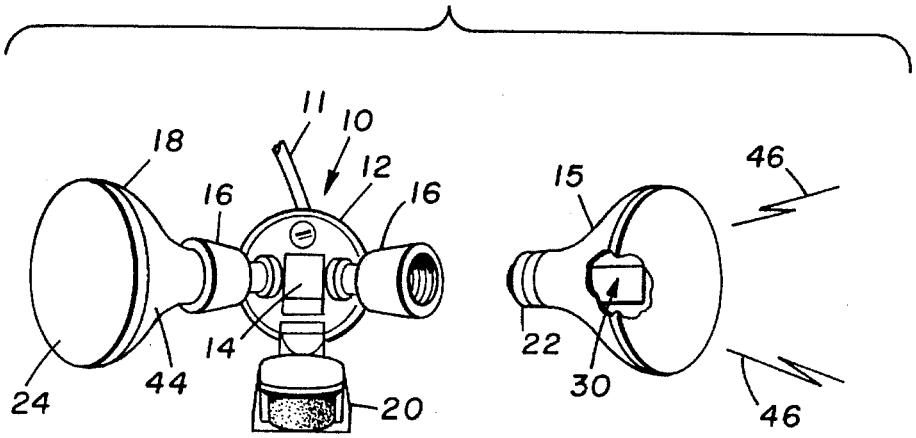
FIG. 2 is a perspective view of a motion detector assembly and a transmitter illustrated in an exploded form wherein, the transmitter is shown encased within an enclosure configured to duplicate the appearance of a floodlight bulb.

Referring now to FIG. 2 an embodiment of the invention is illustrated wherein the transmitter 30 of the system is mounted within a housing 15 which is configured to duplicate the visual features of a floodlight bulb. Such a configuration would make it impossible for an intruder to determine that the wireless system was a part of a typical motion detector operated light fixture. The transmitter may also be hidden from view by mounting it within the base 12 of the light fixture 10. It is noted that the base of many existing light fixtures having a motion sensing detector are formed of a plastic which will permit the passage of electromagnetic energy therethrough and therefore require no modification in this regard. The embodiments illustrated in FIGS. 1 and 2 may be used with no modification to the original light fixture.

Figure 3:
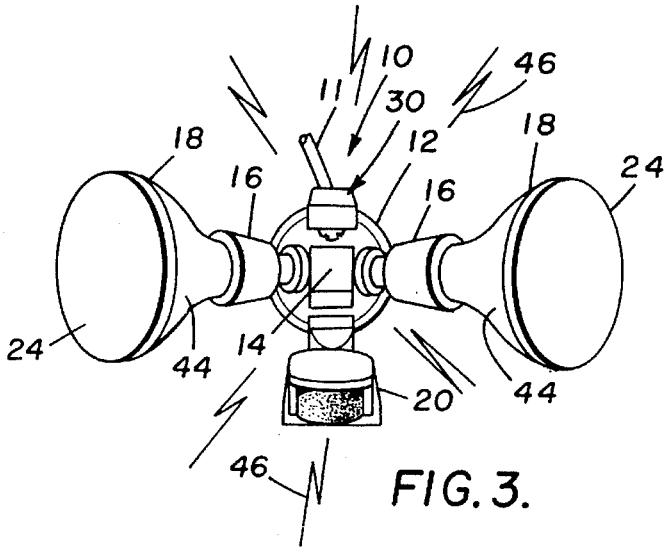
FIG. 3 is a perspective view of a motion detector assembly and a transmitter wherein the transmitter is shown attached to the base of the motion detector assembly.

Referring now to FIG. 3, the embodiment illustrated therein features the mounting of a transmitter 30 to the base 12 of the fixture 10. This embodiment may typically be used with a minimum of modification to the original light fixture so as to attach the transmitter thereto. The attachment of the transmitter to the detector device would typically involve no more than electrical and mechanical attachment of the transmitter 30 to the base 12 by utilizing a simple mounting kit. It is noted that the base of many existing therefore light fixtures having a motion sensing detector include an unused hole for the attachment of an additional bulb or accessory. This unused hole provides a convenient means for mounting the transmitter 30. If an extra hole is not provided, a commercially available substitute base having the appropriate number of holes may be provided at a small cost, or as a part of the transmitter and receiver kit.

Figure 4:
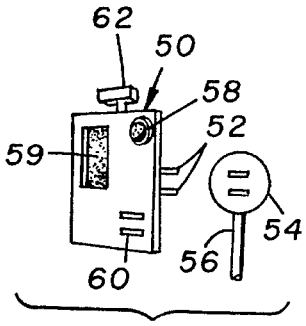
FIG. 4 is a perspective view of a receiver and a power source illustrated in an exploded form.

Referring now to FIG. 4, a receiver 50 is adapted to receive the electromagnetic energy 46 emitted by the transmitter 30 in a frequency range compatible to that emitted by the transmitter and will actuate an internal switch (not shown) in response to reception of the electromagnetic signals. The receiver 50 includes a set or prongs 52 which are adapted for insertion into an electrical receptacle 54 which is connected to a power source 56. The power source 56 will hereinafter be referred to as a secondary power source. The receiver 50 is adapted to switch electrical power from the secondary power source to one or more of selected action components which are a part of the receiver. The action components include a light 58, an audio alarm 59, and an electrical receptacle 60. Electrical current may be directed to one or more of these components, as desired, by operation of a circuit selector 62. The circuit selector 62 is in effect a multiple contact switch the design of which is within the skill of the art. The switching of electrical power from the secondary power source to the circuit selector and ultimately to an action component of the receiver is performed by the receiver 50 in response to reception of the electromagnetic signals 46 from the transmitter 30. A variety of electrically operated devices may be connected for operation by the receiver, by simply plugging them into the receptacle 58. By way of example, these devices may include devices as simple as a table lamp or a doorbell, or as complex as an automatic telephone system for alerting police or commercial security services. Of great importance in the use of this system is the feature that additional receivers may be utilized in desired locations. The only requirement for the use of such receivers being the availability of a conventional household electrical receptacle. While the above described configuration offers many advantages, a receiver may be configured with a single action component if desired.

The circuitry and mechanical design of the components of this device may obviously be accomplished by one skilled in the art.

In installation of the present invention operation, the user need only attach a transmitter 30 to a conventional light fixture 10 which, as illustrated in the drawings and described above, is provided with a motion detector or similar intruder detection switching device, and then plug the receiver 50 into a remotely located conventional electrical receptacle. As in the embodiments illustrated in FIGS. 1 and 2, the transmitter attachment may be as simple as changing a conventional household light bulb. As illustrated in the drawings all removable electrical connectors are of the conventional 120 volt household variety.

In operation, the primary power source 11 which feeds the light fixture is controlled by the intruder detection device so as to switch power from the primary power source 11 to the light bulbs 18 of the light fixture 10. Having placed the transmitter 30 into the switched circuit of the detection device, as in any one of the embodiments illustrated in FIGS. 1, 2 or 3 and described hereinabove, the transmitter is ready for operation. The transmitter receives power in response to the initial actuation or switching of power from the primary power source to the transmitter by operation of the intrusion detector. This occurs when the device has detected the presence of an intruder. In response to this power switching the transmitter is adapted to immediately emit electromagnetic energy in the form of waves within a predetermined frequency range. In response to reception of the electromagnetic energy from the transmitter 30, the receiver 50 is adapted to switch the power available from the secondary power source 56 and the receptacle 54 to a circuit selector 62 which directs the power to one or more of the action components of the receiver. As pointed out above, the action components include the light 58, the audio alarm 59, and the electrical receptacle 60. The circuit selector 62 provides the user the capability to provide the secondary power actuation to one or more of these components and to other electrical devices the user may wish to activate by use of the electrical receptacle 60.

As pointed out above, several receivers may be simultaneously utilized in the operation of this invention.

Obviously, numerous modifications and variations of the present invention are possible in light of the above teachings. It is therefore to be understood that within the scope of the appended claims the invention may be practiced otherwise than as specifically described herein.

I claim:

1. In a building having an interior and an exterior area said interior having an interior 120 volt electrical power source and said exterior area having an exterior 120 volt power source; an alarm kit disposed for mounting within said interior and within said exterior area for providing a warning to persons within said interior of the presence of intruders within said exterior area, said kit comprising:

an electrical fixture disposed for mounting in said exterior area, said electrical fixture including at least one female 120 volt electrical socket assembly, said female 120 volt electrical socket assembly having an input disposed for connection to said exterior 120 volt power source and further having a threaded 120 volt female output socket;

an intruder detector switching assembly having an electrical input disposed for electrical connection to said exterior 120 volt power source and an output connected to the input of said 120 volt electrical socket assembly for switching supply of electrical power from said exterior 120 volt power source to said output socket of said electrical socket assembly in response to detection of an intruder;

a transmitter having a 120 volt threaded male electrical connector disposed for mating electrical connection to said female 120 volt electrical output socket and for transmission of electromagnetic signals in response to electrical power supplied from said female 120 volt electrical output socket;

a receiver assembly including a receiver for reception of electromagnetic signals from said transmitter, a receiver actuated electrical switch for actuation in response to reception of electromagnetic signals by said receiver, electrical connector means including a 120 volt male plug disposed for connection to said interior 120 volt electrical power source, alarm means including an audio alarm, a visual alarm and an auxiliary 120 volt female electrical receptacle, said receiver further including a manual electrical switch selection means for selective connection of said 120 volt male plug to one or more of said visual alarm, said audio alarm and said auxiliary 120 volt female electrical receptacle, whereby actuation of said transmitter by the presence of an intruder will in turn actuate said receiver actuated switch which will in turn actuate at least one of said visual alarm, said audio alarm and said auxiliary 120 volt female electrical receptacle.

* * * * *